United States Patent [19]

De Broeck et al.

[11] Patent Number: 4,736,090

[45] Date of Patent: Apr. 5, 1988

[54] ELECTRIC HEATING CIRCUIT

[75] Inventors: Erik R. De Broeck, Zemst-Elewijt; Erwin O. Goethals, Berchem, both of Belgium

[73] Assignee: Agfa-Gevaert N.V., Mortsel, Belgium

[21] Appl. No.: 872,277

[22] Filed: Jun. 10, 1986

[30] Foreign Application Priority Data

Jun. 18, 1985 [EP] European Pat. Off. ..... 85200962.0

[51] Int. Cl.[4] ..... H05B 1/02

[52] U.S. Cl. ..... 219/497; 219/501; 219/505; 219/494; 219/471; 219/216; 323/369; 307/117; 307/269

[58] Field of Search ..... 219/504, 505, 501, 499, 219/497, 494, 491, 469, 470, 471, 216, 200; 307/269; 323/369

[56] References Cited

U.S. PATENT DOCUMENTS 3,637,984 1/1972 Irvine ..... 219/501

3,789,190 1/1974 Orosy et al. ..... 219/497

4,114,023 9/1978 Zelinka et al. ..... 219/494

4,554,439 11/1985 Cross et al. ..... 219/497

4,567,353 1/1986 Aiba ..... 219/497

*Primary Examiner*—M. H. Paschall

*Attorney, Agent, or Firm*—William J. Daniel

[57] ABSTRACT

A temperature sensitive control circuit for an electrically heated rotatable drum (11) including an internally disposed electric heater (27) and an electric temperature sensor (28) and, outside of the drum, an electric supply (30) for heating the heater and a D.C. supply (31) for producing a constant electric current through the sensor, wherein the electric connections with the drum occur through two sliding contacts (89, 90) only and a diode (29) bypasses the voltage of the heating supply around the temperature sensor. The heater current supply and the sensor current supply operate alternatively and the sensor measures drum temperature while the heater current is interrupted.

5 Claims, 4 Drawing Sheets

ELECTRIC HEATING CIRCUIT

FIELD OF THE INVENTION

The present invention relates to an electric heating circuit for heating a rotatable member, comprising an electric heater, and a temperature sensor in the form of a temperature-sensitive resistor, both of which are incorporated into the rotatable member, and outside of the rotatable member, a power supply for producing an electric voltage across the heater, a D.C. supply for producing an electric current through the snesor, and a control circuit for controlling the power supply as a function of the electric voltage across the sensor.

BACKGROUND OF THE INVENTION

Heating circuits of the described kind are known, for instance in xerographic copying apparatus in which the fixing of the toner image that has been transferred from a photoconductor towards a plain paper sheet, occurs by means of a heated pressure-fixing roller. The construction of such circuits requires the provision of a plurality of sliding contacts in order to properly connect the sensor and the electric heater to the electric control circuit that is disposed outside of the roller. Since three, and usually four sliding contacts are required, the construction of the roller becomes rather complicated. Furthermore, the sliding contacts call for regular maintenance. A circuit of the described type is disclosed in U.S. Pat. No. 4,035,612.

Further there is known a controlled heating circuit, wherein a resistive heater element is used to heat a device, the same element being also used as a sensor to determine the actual temperature of the device. This type of heating circuit has the advantage of a simple heating and measuring construction, namely one element that requires only two electrical connections, but it has the disadvantage of a low measuring snesitivity since the sensitivity of a resistance heater is much smaller than the sensitivity of a true sensor, such as a thermistor. Another disadvantage of this heating circuit is that the means which are required for achieving an isolation between the heating circuit and the measuring circuit comprise different components which are rather expensive, and/or frequency-determined. A heating circuit of the described kind is disclosed in U.S. Pat. No. 3,103,573.

OBJECT OF THE INVENTION

It is the object of the present invention to provide a heating circuit for heating a rotatable member, that has a high measuring sensitivity and a simple and reliable mechanical and electrical arrangment.

SUMMARY OF THE INVENTION

According to the present invention, an electric heating circuit for heating a rotatable member, comprising an electric heater, and a temperature sensor in the form of a temperature-sensitive resistor, both elements being incorporated into the rotatable member, and outside of the rotatable member, a power supply for producing an electric voltage across the heater, a D.C. supply for producing a constant electric current through the sensor, and a control circuit for controlling the power supply as a function of the electric tension over the sensor, is characterized thereby that the heater and the sensor are electrically connected to the electric circuit through two electric sliding contacts only, the power supply circuit is arranged for producing a periodic electric voltage that is capable of periodically energizing the heater, and a diode is provided within said rotatable member in the circuit of the sensor, which diode makes the sensor inoperative during the active period of said power supply, and operative in the non-active period of said power supply.

The periodic electric power supply voltage may be in the form of a conventional A.C. mains supply, which is half-wave rectified through a diode or the like, but the periodic voltage may also be in the form of a D.C. voltage which is periodically interrupted through a suitable electromagnetic or electronic switch.

According to one embodiment of the heating circuit according to the invention, the heater and the sensor are connected in series, and the diode is connected in parallel across the sensor.

According to another embodiment of the invention, the heater and the sensor are connected in parallel, a diode is connected in series with the sensor branch of the circuit, and a second diode is provided which is connected in series with the heater branch of the circuit in a direction opposite to that of the first diode.

The heating circuit according to the invention is particularly advantageous for use in the heating of the photoconductor drum in a xerographic copying or printing apparatus. As a matter of fact, it has been shown that (moderate) heating of this drum may be necessary in order to avoid undesirable effects of condensation of moisture from the air onto the drum surface, expecially during the warming-up of the apparatus. The mechanical construction of suchlike photoconductor drums is usually not very well suited for the easy arrangement of several sliding contacts that are required for a controlled heating of the drum.

BRIEF DESCRIPTION OF THE DRAWING

The invention will be described hereinafter by way of example with reference to the accompanying drawings wherein.

DETAILED DESCRIPTION OF THE INVENTION

Figure 1:
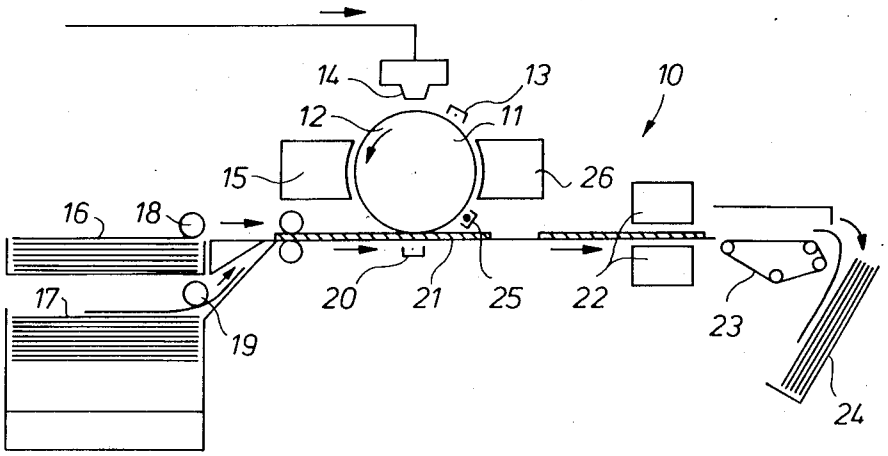
FIG. 1 is a diagrammatic illustration of a xerographic copier.

FIG. 1 shows an electrophotographic printer designated generally by the numerals 10. A photoconductor drum 11 is rotated in the direction of the arrow 12 and uniformly electrostatically charged by corona discharge from a charging station 13. The charged drum is image-wise discharged by appropriate line-wise exposure at exposure station 14 that may comprise a number of closely spaced line-wise arranged radiation sources, such as LED's, that are individually energizeable to record the desired image on the drum surface. The dot-wise discharged pattern that remains after the exposure is developed in a developing station 15 containing a developer with electrostatically charged toner powder that is attracted towards the electrostatic image on the drum. The developed toner image on the drum 11 is transferred to a plain paper sheet fed from either stack 16 or 17 of such sheets. The stack 16 comprises one sheet format, and the stack 17 comprises an other sheet format. A dispenser roller 18 or 19 removes each time the upper sheet from a stack, and feeds it in timed sequence towards the drum 11 so that the leading sheet edge coincides with the leading edge of the toner image on the drum. A transfer corona 20 causes the transfer of the toner image of the drum to the paper sheet 21. The sheet is then transported towards a fixing station 22 where the toner image is fused into the sheet under the application of heat and pressure. The print is finally removed by a conveyor 23, and received in a collecting tray 24. The photoconductor drum is uniformly flooded with light from a rod-like light source 25, and cleaned at a cleaning station 26, so that it is ready for a next printing cycle. It will be understood that the apparatus comprises many other elements known in the art, such as a toner dispenser control system for the control of the correct toner concentration of the developer station, an electric control system for the control of the sequence of the different mechanical operations, an electronic control system including a character generator, a clock signal generator, shift and latch registers, drivers for the LED's, etc. All these components and sub-units of the apparatus are known in the art and irrelevant for the understanding of the present invention, and therefore are not dealt with any further.

Figure 2:
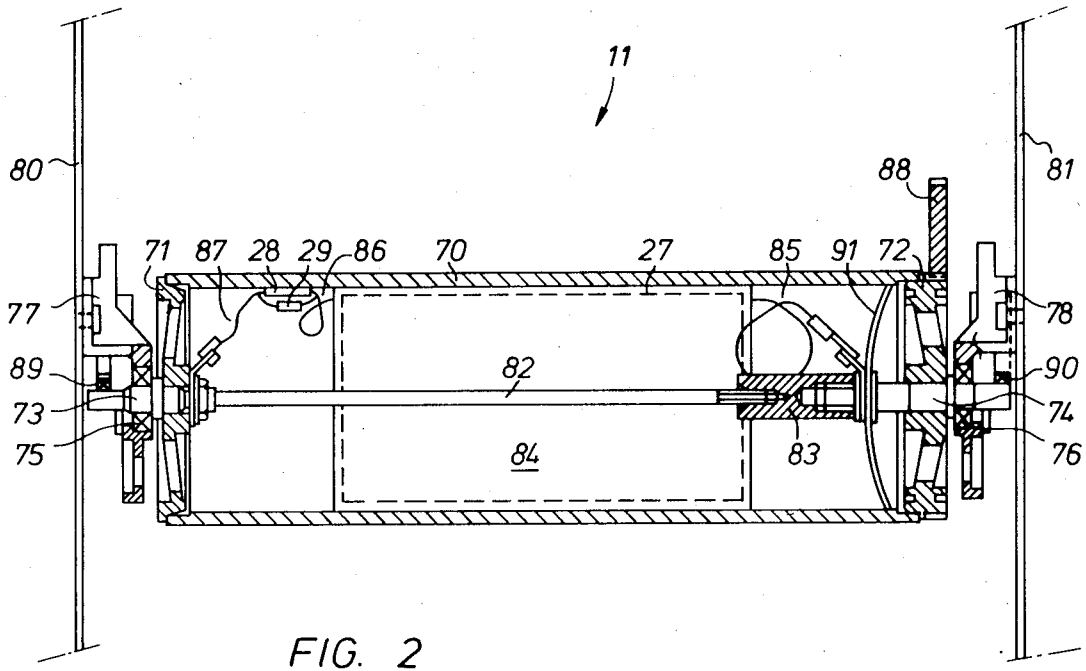
FIG. 2 is a detailed sectional view of the photoconductor drum.

FIG. 2 shows a detailed sectional illustration of the photoconductor drum 11. The drum 11 is a metal cylinder, in the present case an aluminium cylinder 70, that has been provided with a suitable photo-conductor layer (not seen) at its outer surface. The cylinder carries at its extremities plastic caps 71 and 72 wherein shaft ends 73 and 74 are press-fitted. The shaft ends are rotatably journalled in roller bearings 75 and 76 that are mounted in bearing blocks 77 and 78, fitted to lateral walls 80 and 81 of the apparatus. The cap 72 is toothed at its periphery thereby to form a gear wheel that may be driven by a driving gear 88. The caps 71 and 72 slidingly fit into a corresponding recess at each cylinder extremeity, and they are held in place by a central retaining rod 82 that forms an elongation of the shaft end 73 and that is electrically insulated from the opposite shaft end 74 by an insulator 83.

The heater element 27 is in the form of a flexible heating foil that has been adhered to a flexible springlike sheet 84, such as a sheet of beryllium bronze, that allows curvature of the sandwich heater-sheet to adjust to fit the inner diameter of the tube 70, thereby to remain in place in the tube by the spring-biasing force of the metal sheet. The heating foil may be in the form of a strip of flexible printed circuit wherein a conductor that runs in the form of a zig-zag pattern provides the required electrical resistance. One lead 85 of the heater is connected to the shaft end 74, the other lead 86 of the heater has soldered thereon the parallel circuit of the thermistor 28 and the diode 29, which is connected through a lead 87 with the shaft end 73. The thermistor 28 has been secured with a suitable adhesive to the surface of the drum.

Sliding contact with the shaft end 73 is established through a contact finger 89 which is spring-biased against the shaft periphery, whereas the opposite shaft end 74 is in a similar way contacted by a contact finger 90. Finally, there is the contact strip 91 that ensures the electrical contact of the drum with the shaft end 74.

Figure 3:
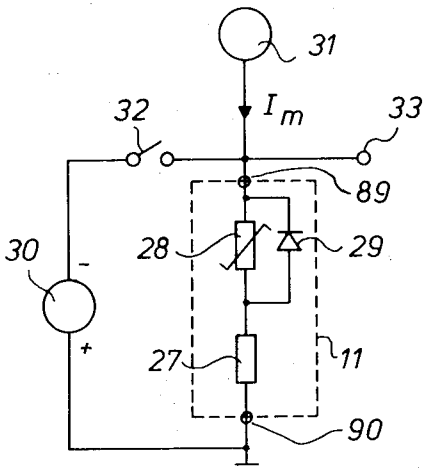
FIG. 3 is a block circuit of one embodiment of an electric heating circuit according to the invention.

A block circuit of a first embodiment according to the invention for the controlled heating of the drum is shown in FIG. 3. The circuit comprises the heater element 27, in the form of an electric heating resistor, the sensor 28 in the form of a temperature-sensitive resistor, a diode 29 in parallel over the sensor, a D.C. power supply source 30, a source 31 for producing a constant D.C. current through the circuit and, in series with the power supply, a switch 32, which is arranged for periodically closing and opening.

When switch 32 is closed, the voltage of the source 30 is applied over the series circuit comprising the resistors 27 and 28. Since in the illustrated arrangement the diode is conductive, a voltage of 0.7 volt develops over the sensor resistor 28 whereas the supply voltage, minus 0.7 volt, stands over the heater resistor 27, whereby this element becomes heated. The effect of the current $I_m$ from the source 31 is neglectable, since said current is of the order of magnitude of some milliamperes only, whereas the current of the source 30 is of the order to magnitude of amperes.

During the period the switch 32 is open, the current produced by source 31 flows through the series resistors 27 and 28. Diode 29 is non-conductive since it becomes reversely biased. The voltage which can be measured at output terminal 33 thus depends on the magnitude of the resistances of both resistors. The resistance of sensor resistor 28 depends on its temperature, and is of the order of magnitude of some kiloohms. The resistance of 27 is temperature independent, i.e., constant, and is of the order of magnetitude of some tens of ohms. The voltage at measuring point 33 is thus practically completely determined by the value resistance at the time of the resistor 28, and in consequence said voltage is a good measure for the temperature of the photoconductor drum 11. The measuring of the output measuring voltage at 33 may occur through the intermediary of appropriate switch means, synchronized with the switch 32, that transmits the measuring voltage at 33 but that does not transmit the power supply voltage of source 30. In practice this switching is performed by appropriate control of a microprocessor in the apparatus that controls the heating along with a number of other functions in the apparatus.

Figure 4:
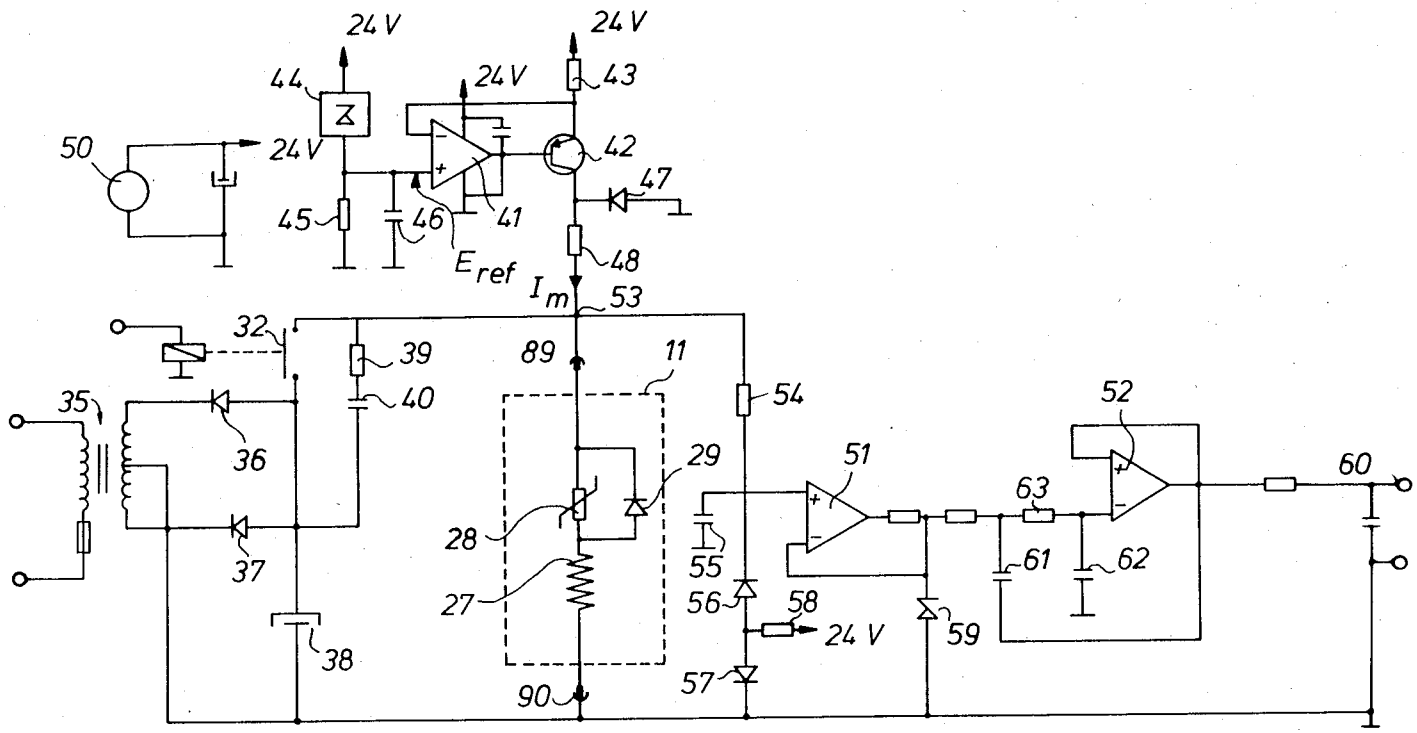
FIG. 4 is the complete electronic circuit of the arrangement of FIG. 3.

The complete electronic circuit of the diagram of FIG. 3 is illustrated in FIG. 4.

The power supply comprises a mains transformer 35, the secondary voltage of which (2×28 V) is double-wave rectified by diodes 36 and 27 and smoothed by capacitor 38. The switch 32 is in the form of a reed-relay which is controlled by the microprocessor of the apparatus. A damping circuit with resistor 39 and capacitor 40 is provided over the switch.

The D.C. supply circuit for the constant current $I_m$ comprises the OP-amp 41, transistor 42, and resistor 43. The voltage $E_{ref}$ of the circuit 41 is produced by the voltage stabilizer 44 over resistor 45 and capacitor 46. The circuit comprising diode 47 and resistor 48 forms a protection of the circuit against negative voltages from the power supply circuit.

A low voltage power supply circuit 50 provices a 24 V supply voltage for the D.C. circuit for $I_m$, and also for the measuring circuit that now will be described.

The measuring circuit comprises the OP-amp's 51 and 52. The measuring voltage at point 53 is applied via a resistor 54 to the non-inverting input of 51. A capacitor 55 operates as a filter to eliminate spikes caused by possible imperfections of the sliding contacts, and to protect thereby the circuit 51. The non-inverting input of the OP-amp is connected via a diode 56 to the diode 57 which over a resistor 58 is connected to the 24 V supply. The purpose of the circuit is to protect the OP-amp 51 against negative input voltage during heating up. The forward voltage drop of diode 57 causes a clamping voltage of approximately 0.7 V, so that the cathode of diode 56 cannot be driven more negatively than 0 Volt (i.e. the voltage drop over 57 minus the voltage drop over 56).

The purpose of zener diode 59 is to limit the output voltage of the circuit to values not exceeding 5 Volt, in order to protect the ADC-convertor (not illustrated) that is connected to the output 60 of the circuit, against such higher input voltages.

The second OP-amp 52 operates as a low pass filter in combination with the capacitors 61 and 62 and the resistor 63 in order to become independent from small contact deficiencies of the sliding contacts of the drum.

The following data illustrate the embodiment of the circuit described hereinbefore, used in an apparatus as illustrated in FIG. 1, for heating a semi-conductor drum with a length equal to 25.6 cm and a diameter equal to 8.4 cm.

Heater resistor 27: 28.8 ohms
Surface: 369 sq.cm
NTC resistor 28: Fenwall UAA41J12C; 12.49K ohms at 20° C. 3.602K drums at 50° C.
Transformer 35: max. 30 W
Diode 29: BY 527
Voltage reference 44: LM 336 B
OP-amp's 41, 51 and 52: LM 324
Resistor 43: 8200 ohms
Diodes 47, 56, 57: types 1N 4148
Zener diode 59: type BZX 79-4V7
Low pass filter for 52: cut-off frequency is 13 Hz
$E_{ref}$: 2.5 V
$I_m$: 0.3 mA The performances of the arrangement were as follows : Temperature rises from 20° to 32° C. in 5 minutes.

Accuracy : 32° C. + or −0.5° C.
Heating period (switch 32 closed) : 14 s
Measuring period (switch 32 opened) : 1 s A second embodiment of an electric heating circuit according to the invention is illustrated diagrammatically in FIG. 5.

The latter circuit comprises a number of elements that are similar to those of FIG. 3, namely the heater 27, the thermistor 28, the diode 29, and D.C. source 31 of a constant current $I_m$. In the present embodiment the power supply circuit is an A.C. source 64 which, in its simplest form, may be the secondary of a mains transformer, for instance a secondary of 24 V A.C., 50 Hz. A diode 65 is mounted in series with the power supply in such a way that the point 66 can be driven only negatively by the power supply. The half-wave rectified current of the A.C. source 64 is conducted over diode 29 towards the heating resistor 27. The diode 29 forms a by-pass over the thermistor 28, apart from the forward voltage drop of 0.7 V over the diode. During the operative (negative) phase of the power supply source, the D.C. current source 31 is protected against damages from the power source 64 by an appropriate resistor and a diode, such as the resistor 48 and the diode 47 illustrated in FIG. 4.

During the positive alternation of the souce 64, the diode 65 blocks the current path therefrom, whereas the souce 31 produces a D.C. current through the thermistor 28, the diode 29 being non-conductive, whereby a voltage arises at point 66 that is representative for the magnitude of the thermistor 28, and thus for the temperature of the drum 11. The influence of the resistor 27 is as described hereinbefore. The signal processor (not seen) for the processing of the measuring signal at point 66 may be controlled to be operative only during the measuring phase of the arrangement.

Figure 6:
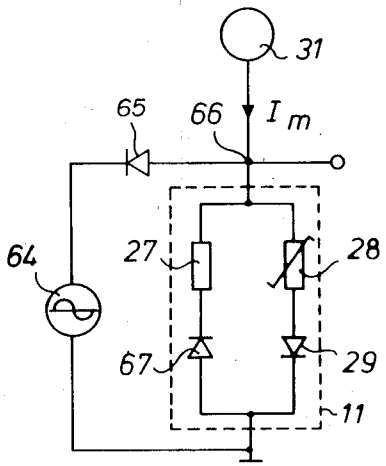
FIG. 6 is a block circuit of a third embodiment of an electric heating circuit according to the invention.

A third embodiment of an electric heating circuit according to the invention is illustrated diagrammatically in FIG. 6.

Figure 5:
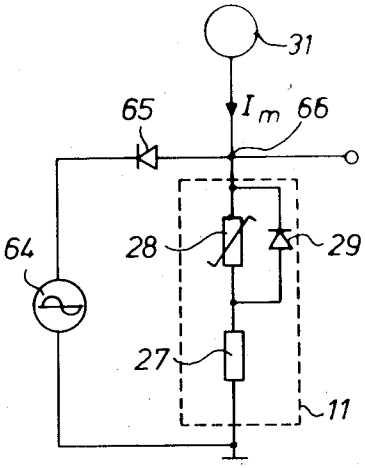
FIG. 5 is a block circuit of a second embodiment of an electric heating circuit according to the invention.

The circuit comprises a number of elements that are similar to those of FIG. 5, namely the heater 27, the thermistor 28, the diode 29, the D.C. source of 31 of a constant current $I_m$, and the A.C. source 64. In the present arrangement, however, the thermistor 28 is not connected in series with the heater 27, but instead is connected is in parallel with the heater circuit, through a diode 67. In the operative phase of the power supply source, the negative phase of the voltage of A.C. source 64 flows through the heater branch 27–67 of the circuit, the thermistor branch being blocked by the diode 29, whereas in the non-operative (positive) phase of the power supply (the current through 27 being blocked by the reversely biased diode 67), the measuring current $I_m$ is capable of flowing through the thermistor 28 via the forwardly biased diode 29. The voltage existing for that phase at the point 66 is a measure for the resistance of the thermistor 28 and thus for the temperature of the drum 11.

The invention is not limited to the described embodiment. The output voltage signal of the control circuit may control the temperature of the drum through a separate controller, rather than through a micro-processor as described, which is capable of performing a lot of other functions such as the control of the toner regeneration, control of the operational sequences of the apparatus, etc. The electric heating circuit may also be used for the controlled heating of a heat-fixing roller in the apparatus, for the controlled heating of a transfer belt in a type of apparatus in which a toner image is transferred via an intermediate belt from a developed photoconductive drum onto a paper sheet, etc.

We claim:

1. An electric heating circuit for a rotatable member comprising an electrical resistance heater and a temperature sensor disposed in electrically connected relationship within said rotatable member, said temperature sensor comprising a resistor having a heat-responsive resistance varying resistor being electrically connected externally of said rotatable member to only two sliding electrical contacts carried by said rotatable member, the resistance of said resistor being large compared to the resistance of said heater, a heater power supply for delivering a heating voltage to said sliding contacts and thence to said resistance heater, means for periodically interrupting such supply of heating voltage to the heater, a separate D.C. power supply operable at least when said heater power supply is interrupted for applying a fixed D.C. electrical current to said sliding contacts for delivery to at least said sensor resistor, a diode connected in series with said resistance heater and in parallel with said sensor resistor and operative to substantially bypass the heating voltage around said sensor resistor while essentially rejecting said fixed D.C. current, and means for measuring the voltage caused by said fixed D.C. current over the temperature sensor during the interruption of said heater power supply to thereby obtain an indication of the temperature of said temperature sensor resistor and thus of said rotatable member.

2. Electric heating circuit according to claim 1, wherein the heater and the sensor are connected in series, and a diode is connected in parallel across the temperature sensor.

3. Heating circuit according to claim 1, wherein the heater and the sensor are connected in parallel, a first diode is connected in series with the sensor branch of the circuit, and a second diode is connected in series with the heater branch of the circuit in a direction opposite to that of the first diode and effective to substantially bypass the sensor branch from the flow of heater voltage.

4. Electric heating circuit according to claim 1 wherein the means for periodically interrupting the supply of heating voltage comprises a source of D.C. voltage and a switch for periodically disconnecting said source.

5. Electric heating circuit according to claim 1, wherein the means for periodically interrupting the supply of heating voltage comprises a source of A.C. and a diode.

* * * * *